US007430837B2

(12) United States Patent
Hubbard

(10) Patent No.: US 7,430,837 B2
(45) Date of Patent: Oct. 7, 2008

(54) MEMBRANE WITH MECHANICAL SECUREMENT ATTACHED

(75) Inventor: Michael J. Hubbard, Maumee, OH (US)

(73) Assignee: BFS Diversified Products, LLC., Indianapolis, IN (US)

( * ) Notice: Subject to any disclaimer, the term of this patent is extended or adjusted under 35 U.S.C. 154(b) by 356 days.

(21) Appl. No.: 10/640,250

(22) Filed: Aug. 14, 2003

(65) Prior Publication Data

US 2005/0055932 A1 Mar. 17, 2005

(51) Int. Cl.
*E04B 5/00* (2006.01)

(52) U.S. Cl. ..... 52/408; 52/410; 52/746.11

(58) Field of Classification Search ..... 52/58, 52/408, 410, 413, DIG. 16, 746.11; 428/40.1, 428/41.7, 41.8; 411/439, 450, 475, 441
See application file for complete search history.

(56) References Cited

U.S. PATENT DOCUMENTS

| | | | | | |
|---|---|---|---|---|---|
| 1,958,871 | A | | 5/1934 | Tucker | |
| 3,616,515 | A | | 11/1971 | Moore | |
| 4,038,454 | A | | 7/1977 | Lehmann et al. | |
| 4,078,961 | A | | 3/1978 | Aoki et al. | |
| 4,091,135 | A | | 5/1978 | Tajima et al. | |
| 4,478,775 | A | | 10/1984 | Endo et al. | |
| 4,656,062 | A | | 4/1987 | Harriett | |
| 4,663,103 | A | | 5/1987 | McCullough et al. | |
| 4,718,211 | A | * | 1/1988 | Russell et al. | 52/409 |
| 4,767,658 | A | * | 8/1988 | Lorenz | 428/192 |
| 4,778,852 | A | | 10/1988 | Futamura | |
| 4,783,942 | A | * | 11/1988 | Nunley et al. | 52/309.1 |
| 4,860,514 | A | * | 8/1989 | Kelly | 52/410 |
| 4,885,887 | A | * | 12/1989 | Simmons et al. | 52/410 |
| 4,910,059 | A | | 3/1990 | Sancaktar | |
| 4,965,119 | A | | 10/1990 | Sancaktar | |
| 4,978,703 | A | | 12/1990 | Ainsworth et al. | |
| 5,161,342 | A | * | 11/1992 | Hasan et al. | 52/410 |
| 5,242,736 | A | * | 9/1993 | Van Erden et al. | 428/137 |
| 5,256,228 | A | | 10/1993 | Davis et al. | |
| 5,286,798 | A | | 2/1994 | Davis et al. | |
| 5,319,908 | A | * | 6/1994 | Van Erden et al. | 52/410 |
| 5,322,724 | A | | 6/1994 | Levens | |
| 5,349,804 | A | * | 9/1994 | Van Erden et al. | 52/746.11 |
| 5,365,709 | A | | 11/1994 | Lassiter | |
| 5,370,755 | A | | 12/1994 | Davis et al. | |
| 5,389,715 | A | | 2/1995 | Davis et al. | |
| 5,469,671 | A | | 11/1995 | Rathgeber et al. | |
| 5,516,829 | A | | 5/1996 | Davis et al. | |
| 5,593,748 | A | | 1/1997 | Hubbard | |

(Continued)

FOREIGN PATENT DOCUMENTS

| | | |
|---|---|---|
| GB | 2123843 | 2/1984 |

(Continued)

*Primary Examiner*—Richard E. Chilcot, Jr.
*Assistant Examiner*—Chi Q Nguyen
(74) *Attorney, Agent, or Firm*—Sarah M. Jabbari; Zollinger & Burleson

(57) ABSTRACT

The present invention provides a roofing product comprising a flexible roofing membrane comprising a layer of a thermoplastic, and a batten strip integral with the roofing membrane, so that the roofing product is flexible. There is also provided a method for securing such a roofing product to a roof deck and a method for manufacturing such a roofing product.

18 Claims, 11 Drawing Sheets

U.S. PATENT DOCUMENTS 5,605,020 A 2/1997 Chambers
5,711,116 A 1/1998 Hasan
5,772,816 A * 6/1998 Hubbard ..... 156/71
5,775,052 A 7/1998 Mayle
5,850,719 A 12/1998 Mayle
5,925,450 A 7/1999 Karabedian et al.
6,004,645 A * 12/1999 Hubbard ..... 428/57
6,021,616 A 2/2000 Mayle
6,055,786 A * 5/2000 Hubbard et al. ..... 52/409
6,131,351 A 10/2000 Locatelli
6,235,365 B1 * 5/2001 Schaughency et al. ..... 428/40.1
6,238,502 B1 5/2001 Hubbard
6,308,482 B1 * 10/2001 Strait ..... 52/408
6,689,449 B2 * 2/2004 Hasan et al. ..... 428/124
6,864,195 B2 * 3/2005 Peng ..... 442/41
6,925,766 B2 * 8/2005 Di Pede ..... 52/408

FOREIGN PATENT DOCUMENTS

WO WO 98/56866 12/1988

* cited by examiner

MEMBRANE WITH MECHANICAL SECUREMENT ATTACHED

BACKGROUND OF THE INVENTION

The present invention relates generally to roofing membranes.

A roof system generally includes a roof deck that comprises the structural supporting surface of a building extending between the surrounding exterior walls of the building. The roof deck may be constructed from plywood, metal decking or concrete or any other suitable material. Depending upon the construction, the roof deck may extend over the surrounding exterior walls or the roof deck may be exposed short of the exterior walls thereby forming a parapet wall, i.e., a low retaining wall at the edge of the roof deck. If desired, the roof system may also include an insulation barrier formed from polyisocyanarate or any other suitable material applied over the roof deck.

To make the roof deck and building weather resistant, a roofing membrane is installed over the roof deck. One typical way of securing a roofing membrane to a roof deck is to use nails or screws that extend through small metal plates that are manually spaced apart in rows on the roofing membrane. The metal plates are covered by overlapping roofing membranes.

One problem encountered when installing roofing membranes is accounting for the wind uplift forces. The wind uplift forces are not evenly distributed across the roof deck and the perimeter of the roof deck, particularly next to a parapet wall which encounters greater wind uplift forces than are encountered on the other areas of the roof deck. Failure to adequately secure the roofing membrane to the roof deck at the parapet wall or anywhere on the roof deck may cause the roofing membrane to separate from the roof deck and/or parapet wall resulting in roof failure and possible damage to the building structure and building interior.

Another problem with most existing methods of installing roofing membranes is that these methods require manually aligning the securing devices on the roofing membrane. This increases the time and labor cost for the installer.

SUMMARY OF THE INVENTION

The present invention overcomes the shortcomings of prior devices and methods by providing a roofing product with one or more layers of thermoplastic having a batten strip integral therein. In addition, a roofing product may also have a layer of fabric between the layers of thermoplastic. A batten strip may have built-in spaced openings for securing a roofing product to a roof deck. In addition, a batten strip may include two or more catch cords for engaging securing devices extending through the batten strip. The structure and features of the roofing product provides improved performance against weather conditions, such as wind and moisture. The roofing product may be made from polymer materials that include flame retardants, UV absorbers or UV screeners to improve weatherability. One advantage of the present invention is that the installing a roofing product to a roof deck that is simple and economical. Another advantage is that the present invention eliminates a substantial amount of labor required to place batten strips and securing device on a roofing product.

According to a first broad aspect of the present invention, there is provided a roofing product comprising: a flexible roofing membrane comprising a first layer, the first layer being comprised of a first thermoplastic; and a batten strip integral with the roofing membrane, wherein the roofing product is flexible.

According to a second broad aspect of the present invention, there is provided a method for securing a first roofing product to a roof deck comprising the steps of: providing a flexible roofing membrane comprising at least one batten strip integral with the roofing membrane; and securing the first roofing product to the roof deck by using securing means that extends through the batten strip into the roof deck, wherein the roofing membrane includes a first layer comprised of a first thermoplastic.

According to a third broad aspect of the present invention, there is provided a method of making a roofing product comprising the steps of: integrally bonding at least one batten strip to a first thermoplastic layer; integrally bonding a fabric layer to the first thermoplastic layer; and integrally bonding a second thermoplastic layer to the fabric layer.

According to a fourth broad aspect of the present invention, there is provided a method of making a roofing product comprising the steps of: forming a batten strip on at least a first side of a fabric layer; integrally bonding the first side of the fabric layer to a first thermoplastic layer; and integrally bonding a second side of the fabric layer to a second thermoplastic layer.

Other objects and features of the present invention will be apparent from the following detailed description of the preferred embodiment.

BRIEF DESCRIPTION OF THE DRAWINGS

The invention will be described in conjunction with the accompanying drawings, in which.

DETAILED DESCRIPTION

It is advantageous to define several terms before describing the invention. It should be appreciated that the following definitions are used throughout this application.

Where the definition of terms departs from the commonly used meaning of the term, applicant intends to utilize the definitions provided below, unless specifically indicated.

For the purposes of the present invention, the term "flexible" refers to any material that is capable of being bent, twisted, bowed, curved, etc. For example, a flexible material may be a material that is capable of being formed into a coil and capable of being unrolled from a coil to lie substantially flat. A flexible material may have the capability to be coiled in any direction. Alternatively, a flexible material may be a material that is capable of being repeatedly folded and unfolded.

The term "roofing membrane" refers to the conventional meaning of the term roofing membrane, i.e. a water impermeable sheet of polymeric material that is secured to a roof deck. A roofing membrane may use polymeric materials such as ethylene propylene diene terpolymer rubber (EPDM), chlorinated polyethylene, PVC, chlorosulfanated polyethylene, TPO, etc. The roofing membrane may be made from a blended composite polymer having additives, such as UV screeners, UV absorbers, fire retardants, etc. to improve weatherability.

The term "roof deck" refers to the conventional meaning of the term roof deck, i.e. a structural supporting surface of a building extending between the surrounding exterior walls of the building. The roof deck may be constructed from plywood, metal decking or concrete or any other suitable material.

Figure 14:
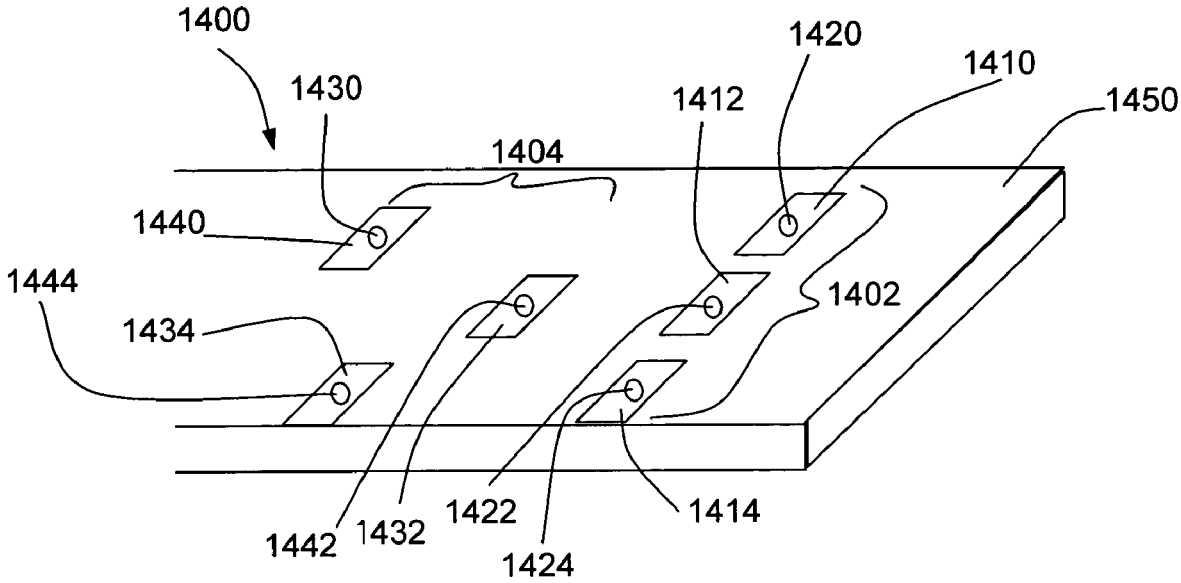
FIG. 14 is a perspective view of a roofing product including a segmented batten strip.

The term "batten strip" refers to any piece of material used in connection with a roofing membrane used to reinforce a region of the roofing membrane so that a fastening device such as a nail, screw etc. that extends through the roofing membrane does not pull through the roofing membrane when the fastening device is used to secure the roofing membrane to a roof deck. The batten strip may be a conventional batten strip that extends the entire width of a roofing membrane or may be a piece of material that acts as a localized reinforcement of the roofing membrane. For example, a batten strip may be one of several circles, squares, etc. of reinforcing material integrally bonded on or within a roofing membrane as shown in FIG. 14. Such batten strips may be arranged in a line or in any other pattern. The batten strip may be made from a blended composite polymer having additives, such as UV screeners, UV absorbers, fire retardants, etc. to improve weatherability.

The term "upper side" refers to a side of a layer of a roofing membrane that does not face a roof deck when the roofing membrane is secured to the roof deck.

The term "bonded side" refers to the side of a layer of a roofing membrane that is bonded to another layer of the roofing membrane. The bonded side may or may not face a roof deck when secured to another layer of roofing membrane, depending on its orientation. A single layer in the roofing membrane may have two sides that are both bonded sides, each bonded side being bonded to an additional layer in the roofing membrane.

The term "lower side" refers to the side of a layer of a roofing membrane or batten strip that faces toward a roof deck when the membrane is secured to the roof deck.

The term "upper layer" refers to a layer of a roofing membrane that is on top when the roofing membrane is secured to a roof deck. An upper layer may be partially overlapped by one or more roofing products.

The term "lower layer" refers to the layer of a roofing membrane that is nearest to a roof deck when the membrane is secured to the roof deck. The lower layer of one roofing membrane may overlap the upper layer of another roofing membrane.

The term "thermoplastic" refers to the conventional meaning of thermoplastic i.e. a compound substance that exhibits the property of a material, such as a high polymer, that softens when exposed to heat and generally returns to its original condition when cooled to room temperature. Examples of thermoplastics suitable for use include thermoplastics such as: PVC and thermoplastic polyolefins such as polyethylene (PE), linear polyethylene (LPE), polybutenes (PB), polypropylene (PP), co-polymers of polyolefins, ethylene-propylene rubber (EPR), ethylene-propylene copolymer (EPM), EPDM blended with PP or PE or copolymer, etc.

The term "thermoplastic polyolefin (TPO)" refers to the conventional meaning of the term "thermoplastic polyolefin" i.e. polyolefins that are thermoplastics. Examples of TPO's that are suitable for use include linear polyethylene, polyethylene, polybutenes, polypropylene, co-polymers, EPR or EPDM blended with PP or PE or copolymer, etc.

The term "UV absorber" refers to any conventional additive blended into a polymer to stabilize the adverse effects of light exposure, such as a loss of strength, degradation and decoloration. The use of a UV absorber may allow at least one layer of roofing membrane to exhibit good weathering characteristics. Examples of preferred UV absorbers additives include benzotriazole, benezophenones, hindered amine light stabilizers (HALS), non-interacting HALS (NOR-HALS), etc.

The term "UV screener" refers to a conventional additive blended into a polymer to reflect ultraviolet rays. Examples of preferred UV screener additives include $TiO_2$, carbon black, zinc oxide, etc.

The term "fire retardants" or "FRs" refer to a conventional additives blended into a polymer to reduce the flammability of a polymer by slow down the rate of combustion. Examples of preferred FRs include magnesium hydroxide, brominated FR, $SbO_3$, etc.

The term "integral" refers to a material that is of one piece or in which two or more materials are permanently bonded together to form a single material. Methods for making a batten strip integral with a roofing membrane, may include coextruding one or more layers of the membrane with the batten strip, welding, chemical bonding, adhesive, weaving, etc. A material is integral when that material is on, within, part of, etc. a second material to form a combined or composite material.

Figure 1:
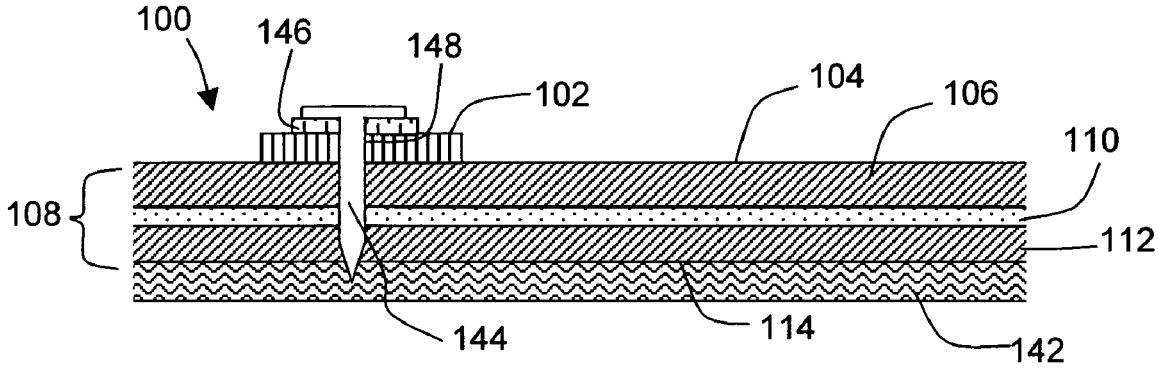
FIG. 1 is a cross-sectional view of a three-layer composite roofing product having a batten strip integrally bonded to the upper layer of roofing membrane of the roofing product.

In FIG. 1, a composite roofing product 100 has a batten strip 102 that is integrally bonded on an upper side 104 of an upper layer 106 of a roofing membrane 108. Roofing membrane 108 includes three layers, upper layer 106, a middle layer 110 and a lower layer 112. Upper layer 106 and lower layer 112 are made of a thermoplastic. Middle layer 106 is made of a fabric material. A lower side 114 of lower layer 112 of roofing membrane 108 lays flat against a roof deck 142. Roofing product 100 is secured to roof deck 142 by a screw 144 that extends through roofing product 100, including batten strip 102, and into roof deck 142. A washer 146 is positioned to surround an opening 148 in batten strip 102 through which screw 144 extends.

Figure 2:
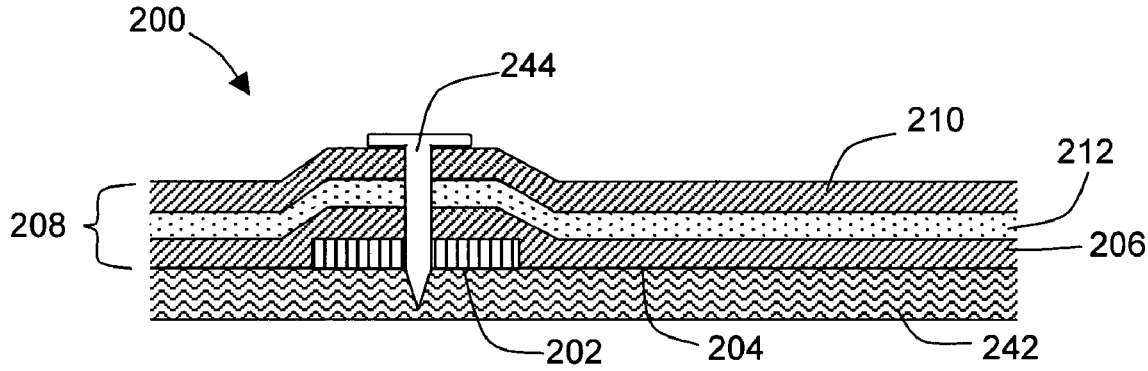
FIG. 2 is a cross-sectional view of a three-layer composite roofing product having a batten strip integrally bonded to the lower layer of a roofing membrane of the roofing product.

In FIG. 2, a composite roofing product 200 has a batten strip 202 is integrally bonded to a lower side 204 of a lower layer 206 of a roofing membrane 208. Roofing membrane 208 includes three layers: an upper layer 210, a middle layer 212 and lower layer 206. Upper layer 210 and lower layer 206 are each made from a thermoplastic. Middle layer 210 is made of a fabric material. Lower layer 210 of roofing membrane 208 and batten strip 202 lay flat against a roof deck 242. Roofing product 200 is secured to roof deck 242 by a screw 244 that extends through roofing product 200, including batten strip 202, and into roof deck 242.

A batten strip may be bonded to an upper side of an upper layer of a roofing membrane or may be co-extruded with the upper layer of a roofing membrane. Although a batten strip, as shown in FIGS. 1 and 2, is shown as being made of a different material than the upper or lower layer, the batten strip may be made of the same material as the upper or lower layer. Further, a batten strip may be a raised portion of an upper layer. Although a washer is shown with a roofing product of FIG. 1, the roofing product may be secured to a roof deck without using a washer.

Figure 3:
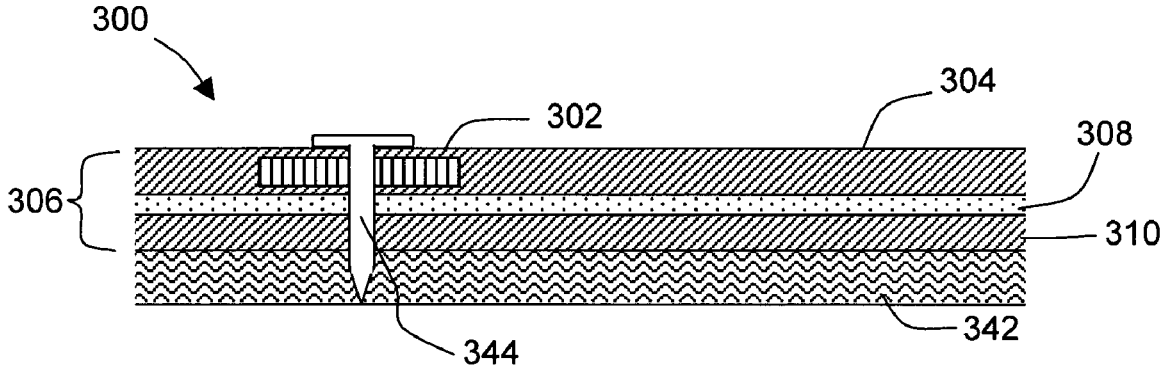
FIG. 3 is a cross-sectional view of a three-layer composite roofing product having a batten strip embedded within the upper layer of roofing membrane of the roofing product.

In FIG. 3, a composite roofing product 300 has a batten strip 302 integrally embedded within an upper layer 304 of a roofing membrane 306. Roofing membrane 306 includes three layers, upper layer 304, a middle layer 308 and a lower layer 310. Upper layer 304 and lower layer 310 are made of a thermoplastic. Middle layer 306 is made of a fabric material. Lower layer 310 of roofing membrane 306 lays flat against a roof deck 342. Roofing product 300 is secured to roof deck 342 by a screw 344 that extends through roofing product 300, including batten strip 302, and into roof deck 342.

Figure 4:
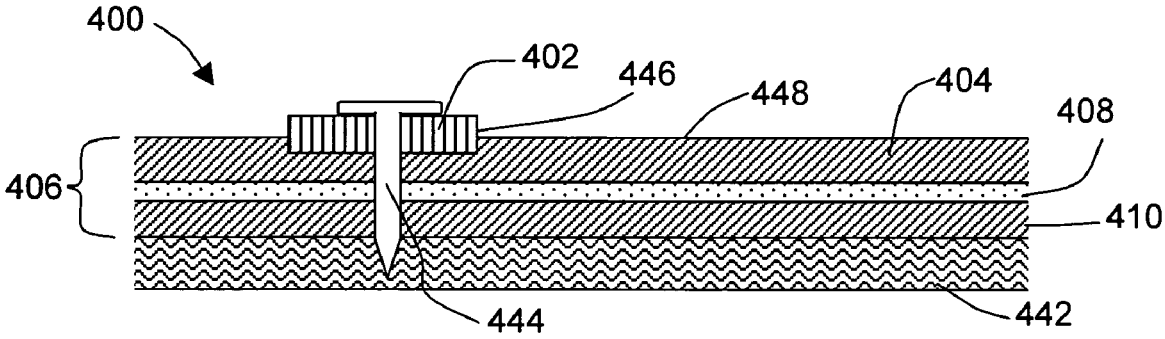
FIG. 4 is a cross-sectional view of a three-layer composite roofing product having a batten strip partially embedded in an upper layer of a roofing membrane of the roofing product.

In FIG. 4, a composite roofing product 400 has a batten strip 402 integrally and partially embedded within an upper layer 404 of a roofing membrane 406. Roofing membrane 406 includes three layers, upper layer 404, a middle layer 408 and a lower layer 410. Upper layer 404 and lower layer 410 are made of a thermoplastic. Middle layer 406 is made of a fabric material. Lower layer 410 of roofing membrane 406 lays flat against a roof deck 442. Roofing product 400 is secured to roof deck 442 by a screw 444 that extends through roofing product 400, including batten strip 402, and into roof deck 442. Batten strip 402 includes a portion 446 that is raised with respect to an upper side 448 of upper layer 404.

Although FIGS. 3 and 4 show a batten strip being embedded within an upper layer, a batten strip may also be located within, or partially within, a middle or lower layer. A batten strip may be raised or depressed with respect to layer within which the batten strip is located.

Figure 5:
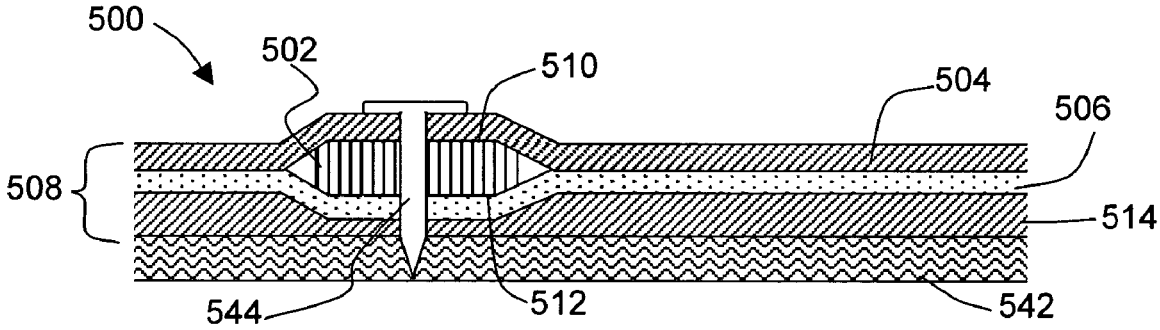
FIG. 5 is a cross-sectional view of a three-layer composite roofing product having a batten strip located between an upper layer and a middle layer of a roofing membrane.

In FIG. 5, a composite roofing product 500 has a batten strip 502 that is located between an upper layer 504 and a middle layer 506 of a roofing membrane 508. Batten strip 502 may be integrally bonded to lower side 510 of upper layer 504, or integrally bonded to upper side 512 of middle layer 506 or integrally bonded to both lower side 510 and upper side 512. Roofing membrane 508 includes three layers: upper layer 504, middle layer 506 and a lower layer 514. Upper layer 504 and lower layer 514 are made of a thermoplastic. Middle layer 506 is made of a fabric material. Lower layer 514 of roofing membrane 508 lays flat against a roof deck 542. Roofing product 500 is secured to roof deck 542 by a screw 544 that extends through roofing product 500, including batten strip 502, and into roof deck 542.

Figure 6:
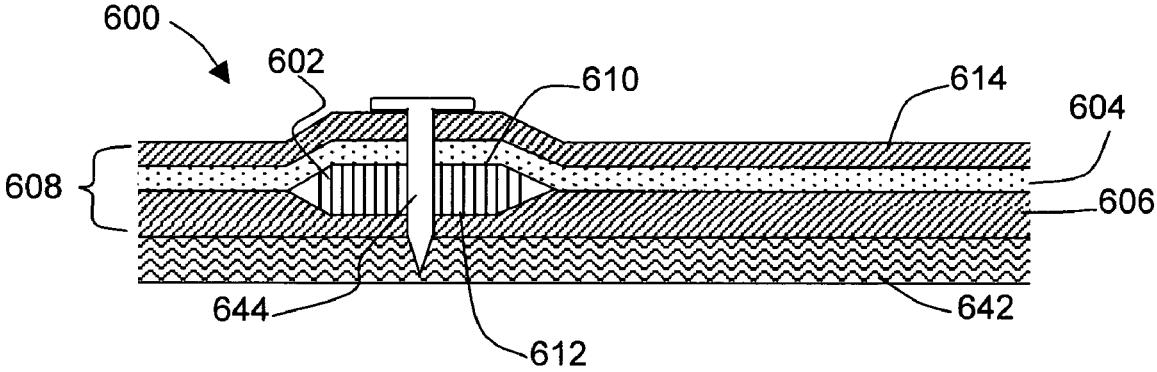
FIG. 6 is a cross-sectional view of a three-layer composite roofing product having a batten strip located between a middle layer and a lower layer of a roofing membrane of the roofing product.

In FIG. 6, a composite roofing product 600 has a batten strip 602 is located between a middle layer 604 and a lower layer 606 of a roofing membrane 608. Batten strip 602 may be integrally bonded to a lower side 610 of middle layer 604, or integrally bonded to an upper side 612 of lower layer 606 or integrally bonded to both lower side 610 and upper side 612. Roofing membrane 608 includes three layers: an upper layer 614, middle layer 604 and lower layer 606. Upper layer 614 and lower layer 606 are made of a thermoplastic. Middle layer 604 is made of a fabric material. Lower layer 606 of roofing membrane 608 lays flat against a roof deck 642. Roofing product 600 is secured to roof deck 642 by a screw 644 that extends through roofing product 600, including batten strip 602, and into roof deck 642.

The roofing product, including the roofing membrane and batten strip, is preferably flexible and more preferably is capable of being rolled and unrolled. A flexible roofing product may allow an installer to position the flexible roofing product in any desired position on a roof deck. In addition, a roofing product that may be rolled into a roll of material allows easier transportation from the manufacturer to the on-site installer.

The roofing product may consist of any number of layers, including a single layer. Preferably, a roofing product may have at least three or more layers. The multiple layers of the roofing product may consist of similar materials or different materials.

A preferred thickness for the roofing product may be 0.001 to 8.0 cm, more preferably be 0.01 to 3.0 cm, and even more preferably 0.0889 to 0.2286 cm. A roofing product should have at least the minimum thickness required for the flute span of the roof when applied to a metal roof.

Upper and lower layers of the roofing membrane may be composed of a thermoplastic polyolefin (TPO). A preferred TPO for the present invention is EPR, PP, or a combination of EPR and PP. Other suitable polymer resins may be used to form the roofing membrane layers. The polymer composition of at least one roofing membrane layer may be blended composition including one or more additives prepared by conventional methods, such as an extrusion process. Such a blended composition may include conventional ultra-violet (UV) absorbers, UV screeners, fire retardants, and other weatherability modifiers. One or more UV absorbers and/or screeners may improve the weatherability of the roofing membrane by preventing a loss of strength, degradation, or discoloration of the roofing membrane. FRs may be added to the polymer to slow down polymer combustion of the roofing membrane when exposed to flames.

A preferred thickness of a layer of roofing membrane may be 0.001 to 8.0 cm. A more preferred thickness of such a layer may be 0.01 to 3.0 cm. Yet another more preferred thickness of such a layer may be 0.0889 to 0.2286 cm.

The width of the roofing product is preferably 0.3 to 3.81 m, more preferably 1.9 to 3.81 m. It should be appreciate that the width of the roofing product may vary depending on the requirements of the manufacturer or installer. In addition, the layers within a roofing product, i.e. roofing membrane layers, will generally have a substantially similar width as the roofing product.

A preferred thickness of the fabric layer is 0.001 to 3.0 cm, more preferably 0.001 to 1.27 cm, and even more preferably 0.015 to 0.066 cm. A preferred woven fabric may have 2-12 threads per cm (5-30 threads per in.) and a thread thickness of 100-3000 denier, and more preferably 4 threads per cm (10 threads per in.) and a thread thickness of 1000 denier.

The batten strip may be a flexible strip having preferred dimensions of 1.27 to 5.1 cm wide and 0.025 to 0.254 cm thick and more preferably 2.54 cm wide and 0.127 cm thick, as described in U.S. Pat. No. 5,469,671, the entire contents and disclosure of which is hereby incorporated by reference. The batten strip may consist of the following materials, fabric, cloth, nylon, metal, PP, PE and PVC. A polymer used in a batten strip may be a blended composition including fire retardants and UV modifying agents as additives. A preferred material for the batten strip is described in U.S. Pat. No. 4,963,430, the contents and disclosure of which is hereby incorporated by reference. As set forth in U.S. Pat. No. 4,963,430 the composition of the batten strip may be from about 80% to 97% by weight of polyethylene terephthalate and from about 3% to 20% by weight of a polyolefin and wherein the polyolefin may be PP.

A batten strip made of fabric may be composed of woven, non-woven or composite fabric materials, either natural or synthetic. Preferably, a fabric batten strip is made of a suitable material to withstand a typical force on a roof deck by having a larger load pull through strength. For example, a typical fabric batten strip is 2.54 cm wide and 0.1016 cm thick, which preferably has a load pull through strength of at least 635 pounds. However, the fabric batten strip may require less pull through strength if more fasteners are used per unit area of roofing membrane to mount a roofing membrane on the roof deck. And conversely, more pull through strength may be required if fewer fasteners are used per unit area of roofing membrane. The load pull through strength of the fabric layer may increase once the fabric layer is integrally bonded within the roofing membrane. In general, fabric batten strips having a high pull through strength are desirable, because they require fewer fasteners and, therefore, less labor to install.

A batten strip may be integrally bonded to, on, or within one side of a roofing membrane layer. The integral relationship between the materials in the roofing product of the present invention is preferred over prior methods of laying a batten strip on top of a roofing product, which is done during the installation of the roofing product. The prior methods required precise alignment that required more time when installing. However, the integral bond between the batten strip and roofing membrane, which may be done during the manufacture of the roofing product, may reduce the time to install the roofing product. The roofing product of the present invention is able to eliminate much of the effort to manually place a batten strip on a roofing membrane.

It should be appreciated that a layer of insulation may be located between a roof deck and lower layer of roofing membrane. An example of an insulation layer is described and disclosed in U.S. Pat. No. 6,238,502, the entire contents and disclosure of which is hereby incorporated by reference. Examples of insulation materials include polyurethane, polystyrene, wood fiberboard, polyisocyanarate, etc. One or more additional layers of insulation may be located between a roofing product and roof deck. Preferably, when a layer of insulation is present a fastener may extend through the layer of insulation into a roof deck.

Figure 7A:
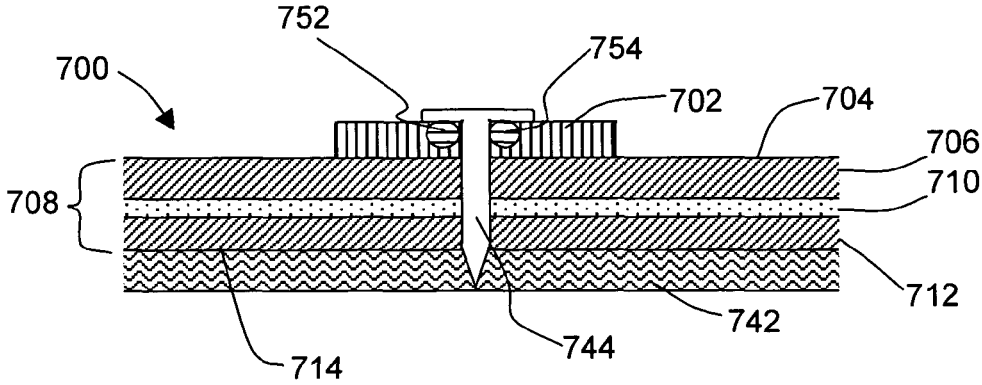
FIG. 7A is a cross-sectional view of a three-layer composite roofing product having a batten strip integrally bonded to the upper layer of a roofing membrane in which the batten strip includes two embedded catch cords.

In FIG. 7A, a composite roofing product 700 has a batten strip 702 that is integrally bonded on an upper side 704 of an upper layer 706 of a roofing membrane 708. Roofing membrane 708 includes three layers, upper layer 706, a middle layer 710 and a lower layer 712. Upper layer 706 and lower layer 712 are made of a thermoplastic polyolefin. Middle layer 706 is made of a fabric material. A lower side 714 of lower layer 712 of roofing membrane 708 lays flat against a roof deck 742. Roofing product 700 is secured to roof deck 742 by a screw 744 that extends through roofing product 700, including batten strip 702, and into roof deck 742. Embedded in batten strip 702 are two catch cords 752 and 754 that extend the length of batten strip 702 and which catch screw 744 to prevent screw 744 from pushing through batten strip 702 and/or pulling away from batten strip 702.

Figure 7B:
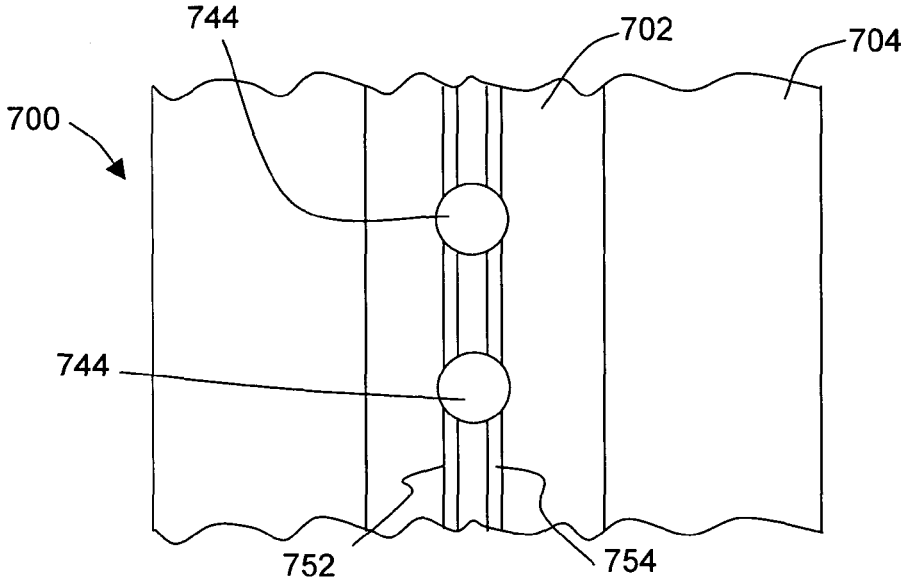
FIG. 7B is a top plan view of a section of the roofing product of FIG. 7A in which the catch cords are in a parallel configuration.
Figure 7C:
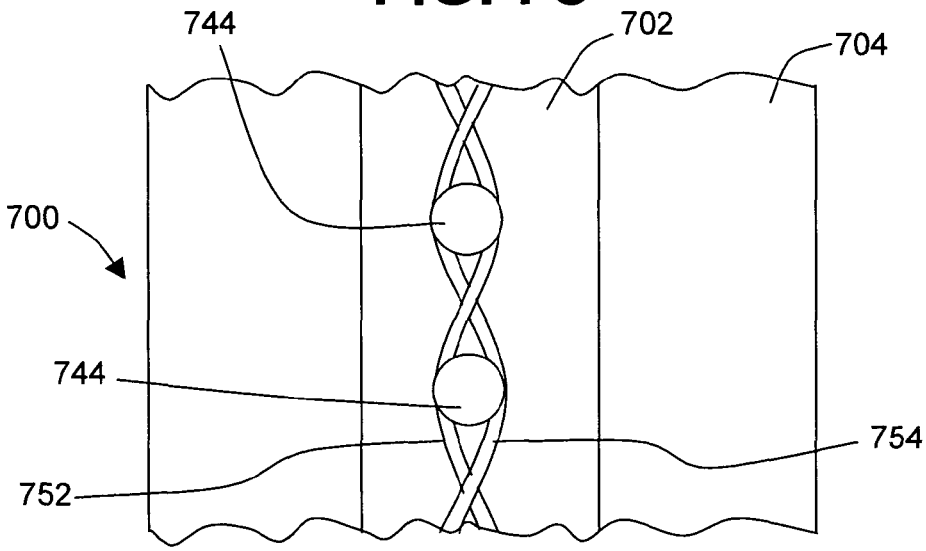
FIG. 7C is a top plan view of a section of the roofing product of FIG. 7A in which the catch cords are in a helical configuration.

Catch cords 752 and 754 may be embedded in batten strip 702 in a parallel configuration as illustrated in FIG. 7B or in a helical configuration as illustrated in FIG. 7C.

Whether in a parallel or helical configuration, preferably the two cords are of equal length are spaced at a width sufficient to catch or grab the head of the securing device inserted between the cords.

The catch cords may each be a string of woven natural or synthetic fabric, such as cotton or nylon, flexible plastic or other suitable material, such as flexible metal wire. The catch cords may be used in various roofing products. The catch cords may be located anywhere within the batten strip. The catch cords may be mounted on or within the batten strip. One or more of the catch cords may extend the entire length of a batten strip. Alternatively, the catch cords may be present in particular portions of a batten strip, such as in the portion where the opening is located.

Figure 8:
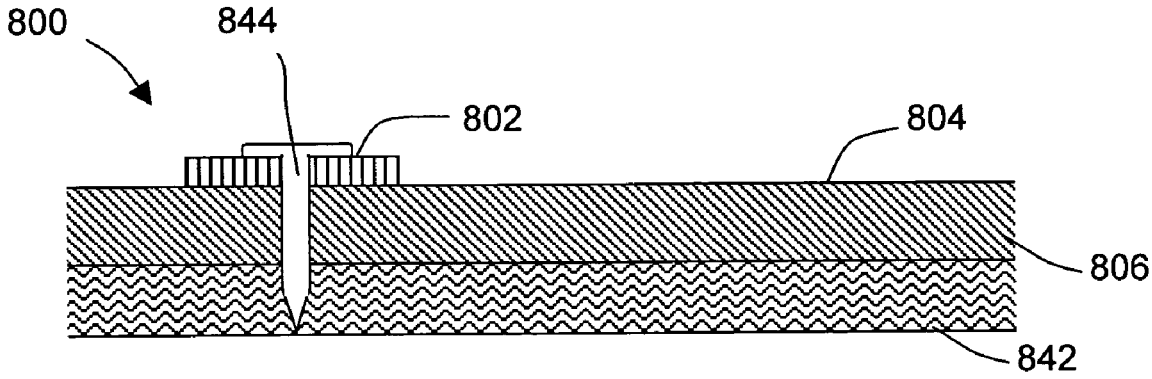
FIG. 8 is a cross-sectional view of a single-layer roofing product having a batten strip integrally bonded to the upper side of the roofing membrane of the roofing product.

In FIG. 8, a roofing product 800 having a batten strip 802 that is integrally bonded on an upper side 804 of a single layer roofing membrane 806. Roofing membrane 806 lays flat against a roof deck 842. Roofing product 800 is secured to roof deck 842 by a screw 844 that extends through roofing product 800, including batten strip 802, and into roof deck 842.

Figure 9:
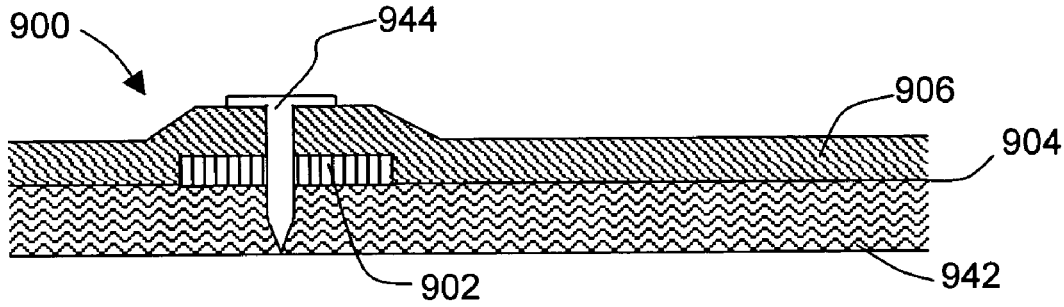
FIG. 9 is a cross-sectional view of a single-layer roofing product of a preferred embodiment of the present invention having a batten strip integrally bonded to the lower side of the roofing membrane of the roofing product.

In FIG. 9, a roofing product 900 having a batten strip 902 that is integrally bonded on a lower side 904 of a single layer roofing membrane 906. Roofing membrane 906 lays flat against a roof deck 942. Roofing product 900 is secured to roof deck 942 by a screw 944 that extends through roofing product 900, including batten strip 902, and into roof deck 942.

Figure 10:
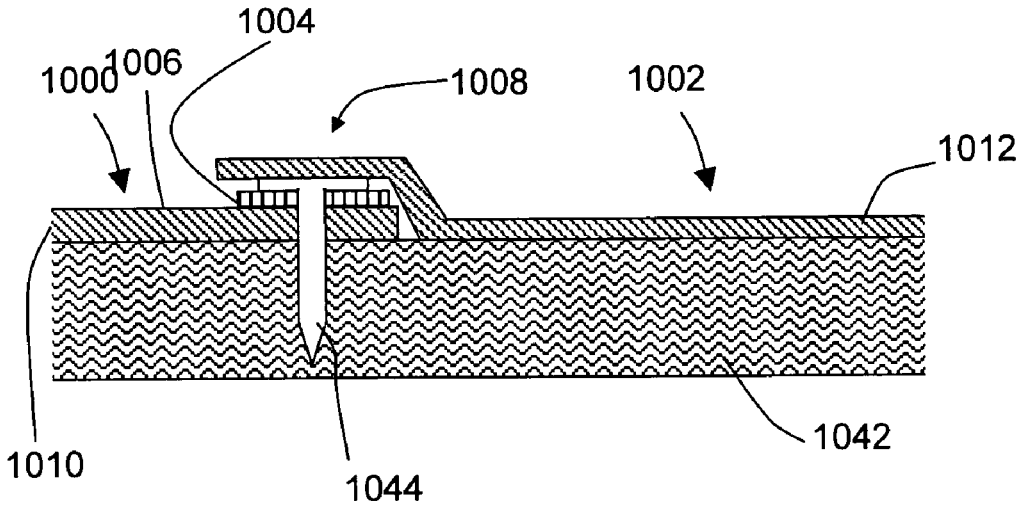
FIG. 10 is a cross-sectional view of two overlapping single-layer roofing products secured to a roof deck.

In FIG. 10, there is shown an overlapping region between two roofing products 1000 and 1002. A batten strip 1004 is integrally bonded to an upper side 1006 of roofing product 1000. An overlapping portion 1008 of roofing product 1002 overlaps roofing product 1000, so that roofing product 1002 covers batten strip 1006. Roofing product 1000 includes a roofing membrane 1010. Roofing product 1002 includes a roofing membrane 1012. Roofing product 1002 has a batten strip (not shown) bonded on the opposing end to connect to another roofing product. Roofing products 1000 and 1002 lay flat against a roof deck 1042. Overlapping portion 1008 lays flat against an upper side 1006 of roofing product 1000. Roofing products 1000 is secured to roof deck 1042 by a screw 1044 that extends through roofing product 1000, including batten strip 1002 and into roof deck 1042.

An overlapping roofing product may be secured to an overlapped roofing membrane by various convention methods such as by hot-welding, using an adhesive, etc.

Figure 11:
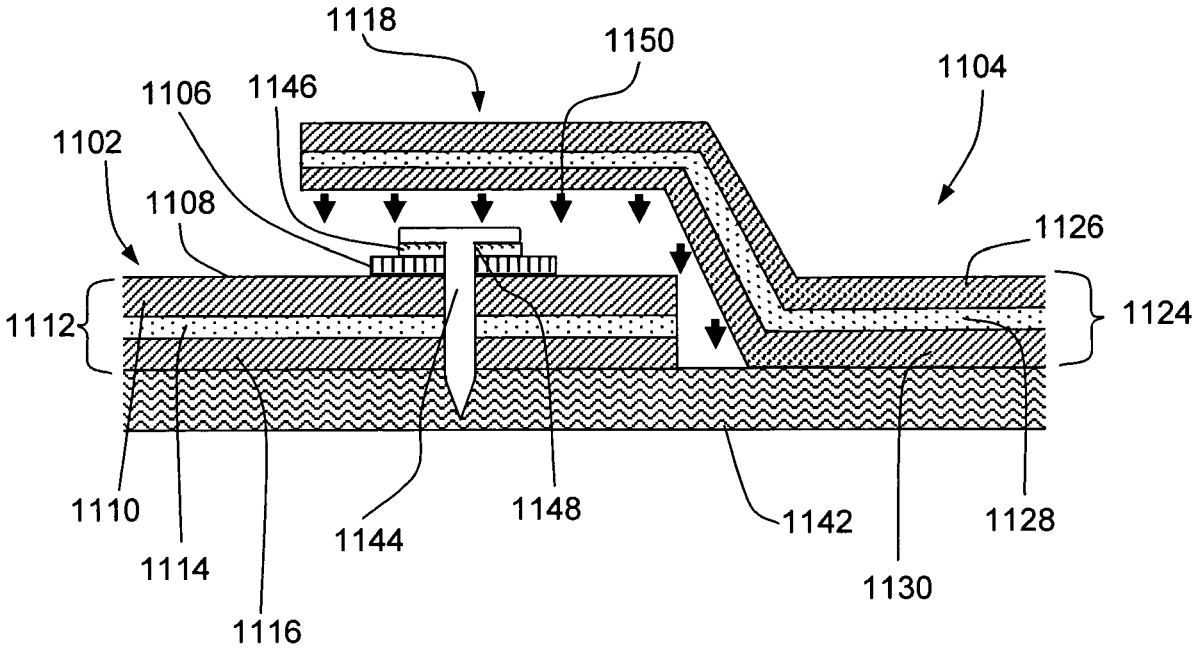
FIG. 11 is a cross-sectional view of two overlapping three-layer roofing products secured to a roof deck.

In FIG. 11, there is shown an overlapping region between two roofing products 1102 and 1104. As shown in FIG. 11, a batten strip 1106 is integrally bonded on an upper side 1108 of an upper layer 1110 of roofing membrane 1112 of roofing product 1102. Roofing membrane 1112 includes three layers: upper layer 1110, a middle layer 1114 and a lower layer 1116. Upper layer 1110 and lower layer 1116 are made of a thermoplastic polyolefin. Middle layer 1110 is made of a fabric material. An overlapping portion 1118 of roofing product 1104 overlaps roofing product 1102. Roofing membrane 1124 includes three layers: upper layer 1126, middle layer 1128 and lower layer 1130. Roofing product 1102 is secured to roof deck 1142 by a screw 1144 that extends through roofing product 1102, including batten strip 1106, and into roof deck 1142. A washer 1146 is positioned to surround an opening 1148 in batten strip 1106 through which screw 1144 extends. Roofing product 1104 is secured in the direction of arrows 1150 to upper side 1108 of roofing membrane 1112 so that roofing product 1104 covers batten strip 1106.

Although not shown in FIG. 11, roofing product 1104 may include a batten strip (not shown) and may be overlapped by another an additional roofing product (not shown). The additional roofing product is positioned over roofing product 1104 to cover batten strip. This may be repeated as necessary over the field of the roofing deck.

Although particular types of roofing products of the present invention are shown in FIG. 11, various embodiments roofing products of the present invention may overlap each other as shown in FIG. 11.

In an alternative embodiment of the present invention, the batten strip may be located on top of both overlapping roofing membranes. This arrangement may allow a screw to extend through two overlapping roofing membranes.

Figure 12:
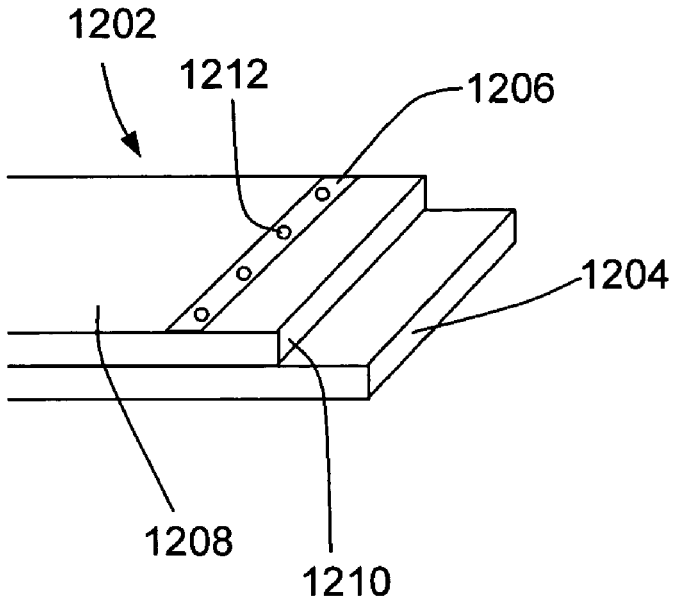
FIG. 12 is a perspective view of a roofing product including a batten strip with preformed openings.

In FIG. 12, there is shown a perspective view of a roofing product 1202 secured a roof deck 1204. A batten strip 1206 is integrally bonded to an upper side 1208 of a roofing membrane 1210. Preformed openings 1212 in batten strip 1206 allow the installation of securing devices, such as screws, nails, bolts, etc. (not shown), so that roofing product 1202 may secured to roof deck 1204.

Figure 13:
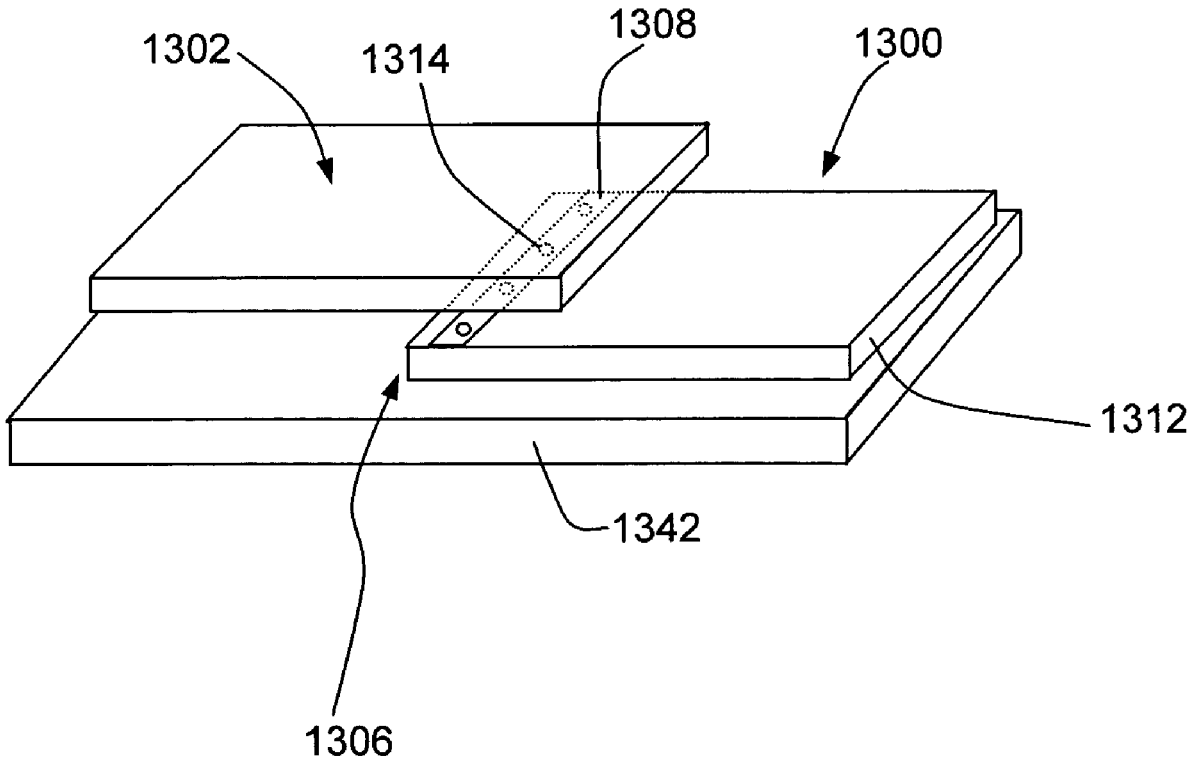
FIG. 13 is a perspective view of a roofing product including a batten strip with preformed openings overlapped by another roofing product.

In FIG. 13, there is shown a perspective view of an overlapping region between two roofing products 1300 and 1302. An overlapping portion 1306 of roofing product 1302 overlaps roofing product 1300, to cover a batten strip 1308 bonded on roofing membrane 1312. Batten strip 1308 has preformed openings 1314 through which securing devices, such as screws, nails, bolts etc. (not shown), may be driven to secure roofing product 1300 to a roof deck 1342.

A preferred spacing of openings is 5 to 40 cm apart, more preferably about 15 cm apart. Preferably the openings are at substantially regular intervals. The spacing of the openings may vary depending on the flute span of the roofing deck. Also, instead of the pre-made openings shown in FIGS. 12 and 13, the batten strip may be marked at desired spaced intervals with indicia so that the securing device may driven through the batten strip at pre-determined intervals when the roofing product is installed on a roof deck.

Preferably, there should be little gap between the roofing products in the region where two roofing products overlap each other and where the batten strip is located. The bottom roofing product may be fastened used the batten strip and securing device. The top roofing product may be hot-welded directed on top of the bottom roofing product to substantially cover the batten strip. This configuration may create an air-tight seal between overlapping roofing products.

It should be appreciated that a roofing product of the present invention may be secured to a parapet wall in addition to being secured to a roof deck.

A securing device may be any type of conventional securing device, such as screws, bolts, nails, seam discs, etc. for securing the roofing membrane to the roof deck, a plurality of conventional screw type securing devices and one or more batten strips or, if desired, a suitable combination of the foregoing. A washer may be used with various embodiments of the present invention in addition to the embodiments in which a washer is shown in the drawings.

The screw type securing devices may be conventional screws of the type commercially available from Olympic Securing devices, ITW Buildex, SFS Stadler and Tru-Fast. Similarly, the batten strips and seam discs may also be of a conventional design and of the type commercially available from Olympic Securing devices, ITW Buildex, SFS Stadler, Tru-Fast and Talan Products Inc.

There may be an anchor means that attaches to the securing device on the interior side of the roof deck. The anchor means may further secure the roofing product to the roof deck when the roof deck is made of a thin or weak material.

Although roofing products shown in the drawing figures have one or three layers, the roofing membrane of the present invention may have any number of layers including two layers or more than three layers. For example, a roofing product may have just two layers of TPO without a layer of fabric.

The roofing membrane is positioned to lay flat against the roof deck so that an edge of the roofing membrane is aligned with an edge of the roof deck. This edge may be bounded by a parapet wall or similar edge. The roofing membrane has a batten strip located near the edge for securing the edge of the roofing membrane to the roof deck. In addition, the roofing membrane may a batten strip that is positioned on a parapet wall to further secure the roofing membrane.

A batten strip is preferably located approximately 1.0 cm to 10 cm from an edge of the roofing membrane and more preferably approximately 6.35 cm from one edge of the roofing membrane. However, the batten strip may be located anywhere on a roofing membrane and a roofing membrane may include more than one batten strip.

A roofing product may cover the entire field of the roof deck. In such a case, one roofing product may have at least two batten strips located at opposing edges of the roofing product for securing to the roof deck. Additional batten strips may be used to further secure the roofing product to the roof deck. These batten strips may be positioned on every edge, or spaced within a single roofing product. The arrangement of batten strips at every edge may improve the roofing product's performance against weather conditions.

The integral placement of the batten strip in relationship to the roofing membrane provides good weather performance against wind, temperature, and moisture. The integral relationship prevents the roofing membrane from sliding or slipping out from underneath the batten strip or other attachment means. In preventing sliding or slipping, the integral design also prevents any enlargement of the openings in the batten strip. In addition, the further support of the cords may prevent any gaps or unfilled holes that may surround the screw in the batten strip.

FIG. 14 shows a roofing product 1400 having one batten strip set 1402 arranged in a linear pattern and another batten strip set 1404 arranged in a non-linear pattern. Batten strip set 1402 includes individual batten strips 1410, 1412, and 1414 that each include preformed openings 1420, 1422, and 1424 respectively for use with a securing device. Batten strip set 1404 includes individual batten strips 1430, 1432, and 1434 that each include preformed openings 1440, 1442, and 1444 respectively for use with a securing device.

The batten strips may have various sizes and shapes. For example, batten strips may be rectangular, square, round, oval, or any other shape.

Figure 15:
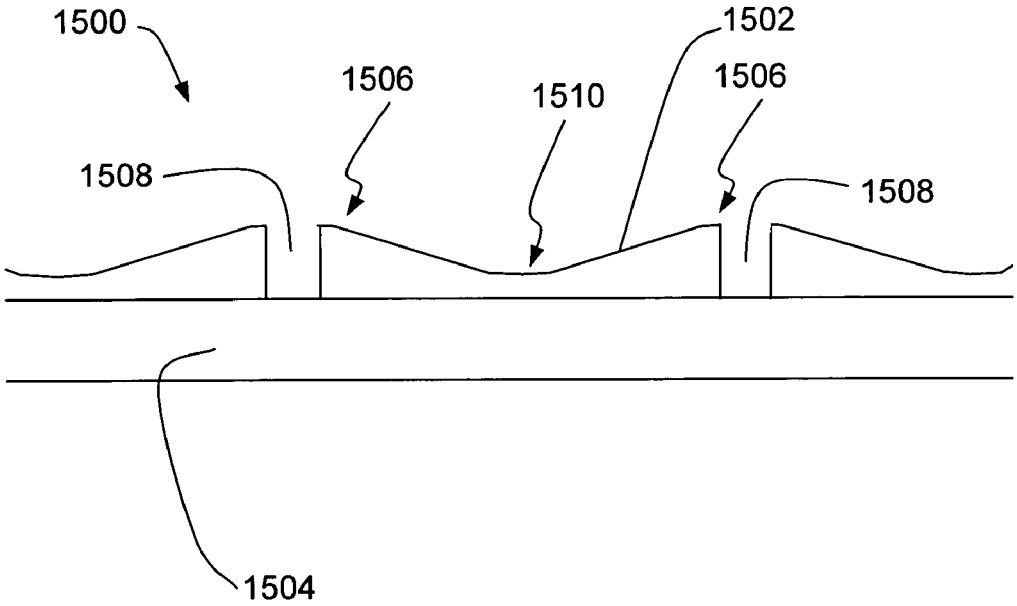
FIG. 15 is a cross-sectional view of a roofing product having a non-uniform thickness.

FIG. 15 shows a roofing product 1500 having a batten strip 1502 with a non-uniform thickness that is integral with a roofing membrane 1504. Reinforced regions 1506 of batten strip 1502 surrounds each opening 1508. Each reinforced region 1506 is thicker than non-reinforced regions 1510.

Although in the roofing product of FIG. 15, the preformed openings in the batten strip do not extend through the roofing membrane, preformed openings may extend through the roofing membrane.

Figure 16:
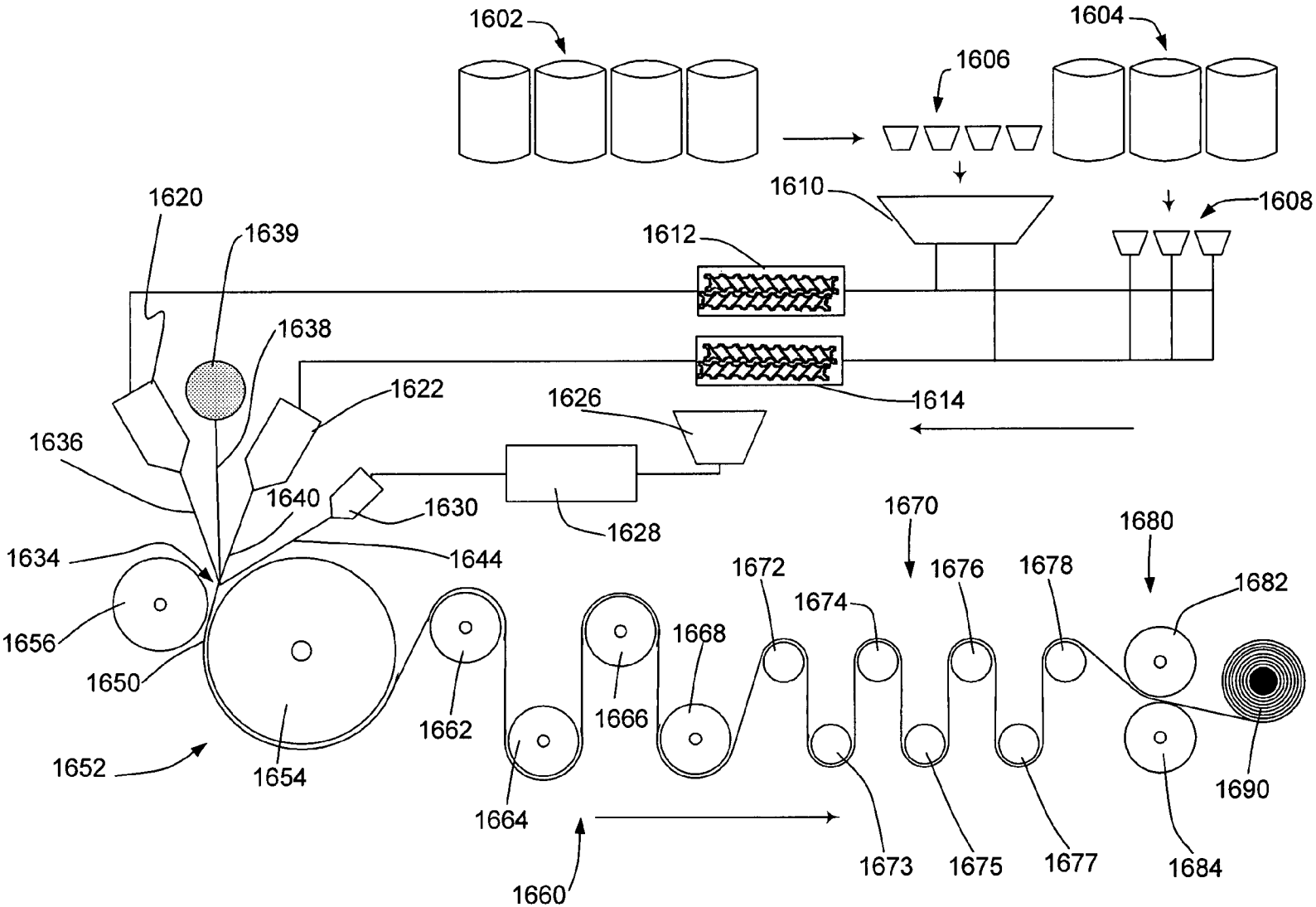
FIG. 16 is a schematic view of a method for forming a roofing product with an integral batten strip in accordance with one embodiment of the present invention.

The roofing product of the present invention may be made in a variety of ways. For example, FIG. 16 illustrates a method for co-extruding a roofing product in which a batten strip is integrally bonded on an exterior side of a thermoplastic layer of a roofing membrane. Resins stored in silos 1602 and silos 1604 are inputted into feeders 1606 and feeders 1608, respectively. Resins in feeders 1606 are inputted into hopper 1610. Resins from feeders 1608 and hopper 1610 are then forced through screw extruders 1612 and 1614. Resin in screw extruder 1612 is pumped through a die 1620 and resin in screw extruder 1614 is pumped through die a 1622. Batten strip material is inputted into feeder 1626, which is pulled into an extruder 1628 and pumped through a die 1630. At location 1634 a continuous thermoplastic sheet 1636 drawn from die 1620, a fabric sheet 1638 from a roll 1636, a continuous thermoplastic sheet 1640 drawn from die 1622, and a continuous batten strip 1644 drawn from die 1630 are brought together to form a pre-roofing product 1650 in which batten strip 1644 is integrally bonded to thermoplastic sheet 1640, thermoplastic sheet 1640 is integrally bonded to fabric sheet 1638, and fabric sheet 1638 is integrally bonded to thermoplastic sheet 1636. Pre-roofing product 1650 is pulled through laminator 1652 by drum 1654 and drum 1656 to reinforce integral bonds between thermoplastic sheet 1636, fabric sheet 1638, thermoplastic sheet 1640 and continuous batten strip 1642. Pre-roofing product 1650 is drawn into a cooling apparatus 1660 by drum 1662, drum 1664, drum 1666 and drum 1668. Pre-roofing product 1650 is drawn through an accumulator 1670 by drum 1672, drum 1673, drum 1674, drum 1675, drum 1676, drum 1677 and drum 1678. Winder 1680 pulls pre-roofing product 1650 from accumulator 1670 by using drum 1682 and drum 1684 into a coil 1690 of continuous roofing product material. To form a roofing product, coil 1690 is unwound and a section is cut off using any conventional means (not shown) for cutting a roofing membrane from a coil of roofing membrane material.

Figure 17:
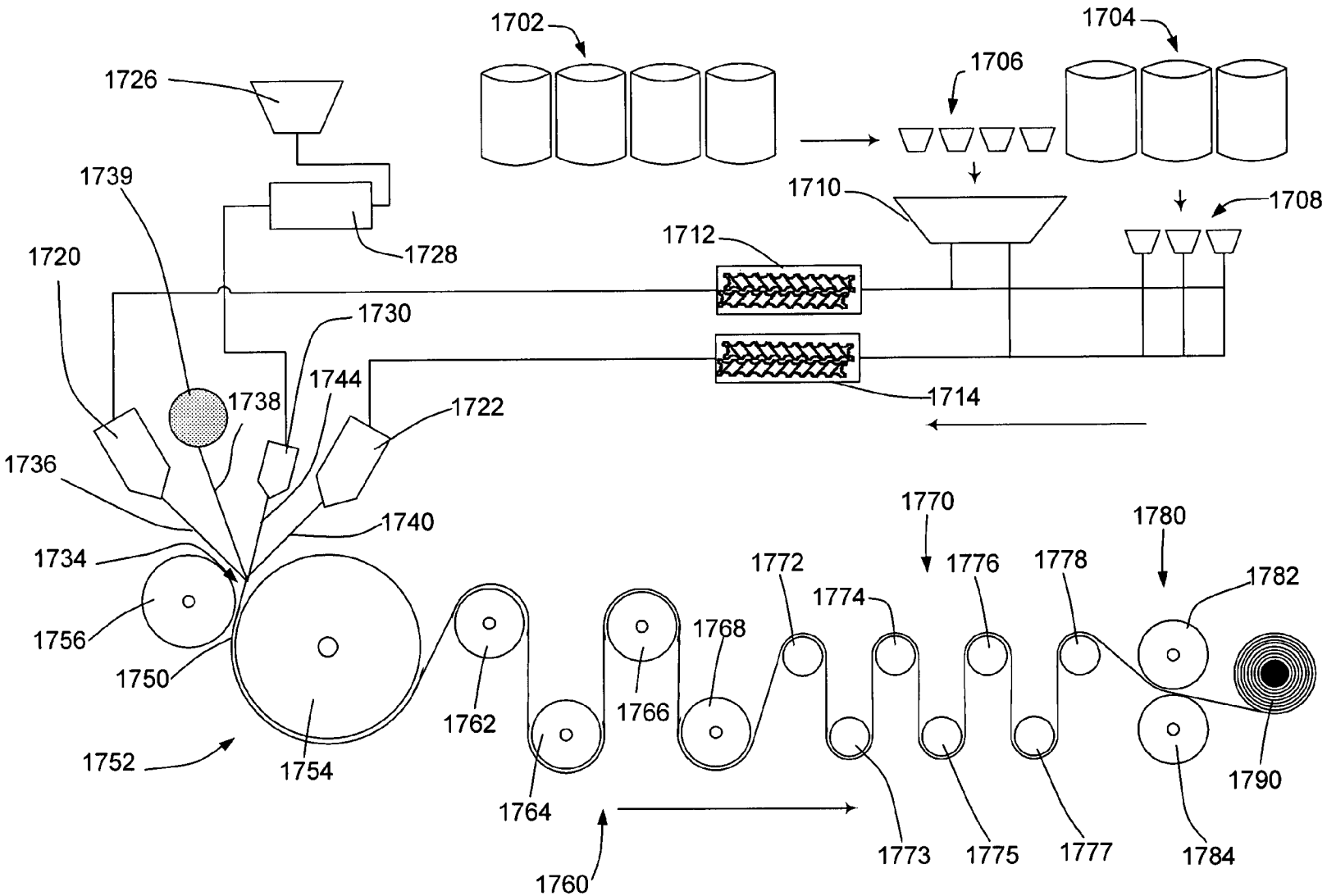
FIG. 17 is a schematic view of a method for forming a roofing product with an integral batten strip in accordance with another embodiment of the present invention.

FIG. 17 illustrates a method for co-extruding a roofing product in which a batten strip is integrally bonded between a thermoplastic layer and a fabric layer of a roofing membrane. Resins stored in silos 1702 and silos 1704 are inputted into feeders 1706 and feeders 1708, respectively. Resins in feeders 1706 are inputted into hopper 1710. Resins from feeders 1708 and hopper 1710 are then forced through screw extruders 1712 and 1714. Resin in screw extruder 1712 is pumped through a die 1720 and resin in screw extruder 1714 is pumped through die a 1722. Batten strip material is inputted into feeder 1726, which is pulled into an extruder 1728 and pumped through a die 1730. At location 1734 a continuous thermoplastic sheet 1736 drawn from die 1720, a fabric sheet 1738 from a roll 1739, a continuous thermoplastic sheet 1740 drawn from die 1722, and a continuous batten strip 1744 drawn from die 1730 are brought together to form a pre-roofing product 1750 in which batten strip 1744 is integrally bonded to thermoplastic sheet 1740, thermoplastic sheet 1740 is integrally bonded to fabric sheet 1738, and fabric sheet 1738 is integrally bonded to thermoplastic sheet 1736. Pre-roofing product 1750 is pulled through laminator 1752 by drum 1754 and drum 1756 to reinforce integral bonds between thermoplastic sheet 1736, fabric sheet 1738, thermoplastic sheet 1740 and continuous batten strip 1742. Pre-roofing product 1750 is drawn into a cooling apparatus 1760 by drum 1762, drum 1764, drum 1766 and drum 1768. Pre-roofing product 1750 is drawn through an accumulator 1770 by drum 1772, drum 1773, drum 1774, drum 1775, drum 1776, drum 1777 and drum 1778. Winder 1780 pulls pre-roofing product 1750 from accumulator 1770 by using drum 1782 and drum 1784 into a coil 1790 of continuous roofing product material. To form a roofing product, coil 1790 is unwound and a section is cut off using any conventional means (not shown) for cutting a roofing membrane from a coil of roofing membrane material.

Although only two methods of making a roofing product are described above, other methods of making roofing product may be used. For example, the batten strip may be sewn onto a fabric material and the fabric material and integral batten strip then laminated between two thermoplastic layers.

Although in the methods described above, both thermoplastic sheets are made from the same thermoplastic, different thermoplastics may be used for each thermoplastic sheet. Also, although the thermoplastic layers in the methods described above are made from two resins, a thermoplastic layer may be made from a single resin.

Preferably, a feeder may be a gravimetric feeder or similar feeder. A screw extruder may be a twin-screw extruder or similar extruder.

It should be appreciated that a single layer of resin may be combined with a batten strip using a similar method as described above. In addition, more layers of resin and/or fabric may be added as necessary. Multiple batten strips may be integral with the layers of material in the roofing product.

Figure 18A:
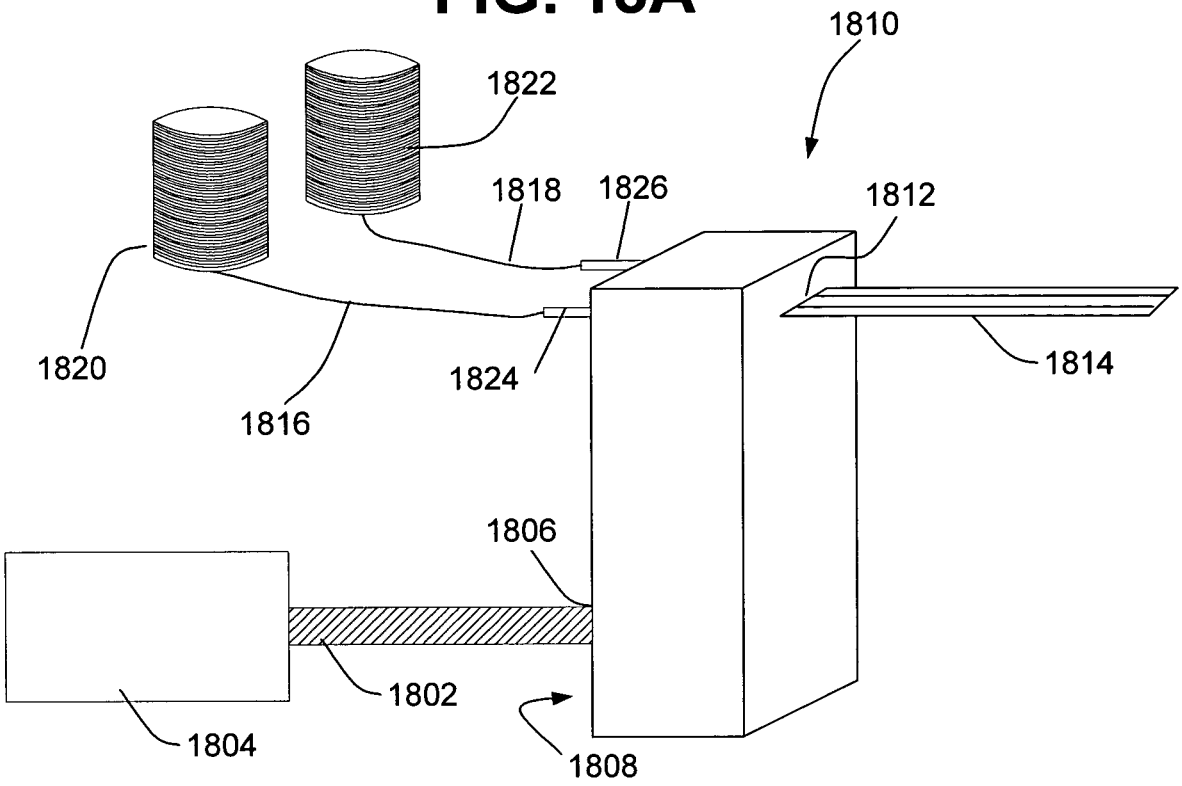
FIG. 18A is a schematic view of a method of embedding two parallel cords in a batten strip.
Figure 18B:
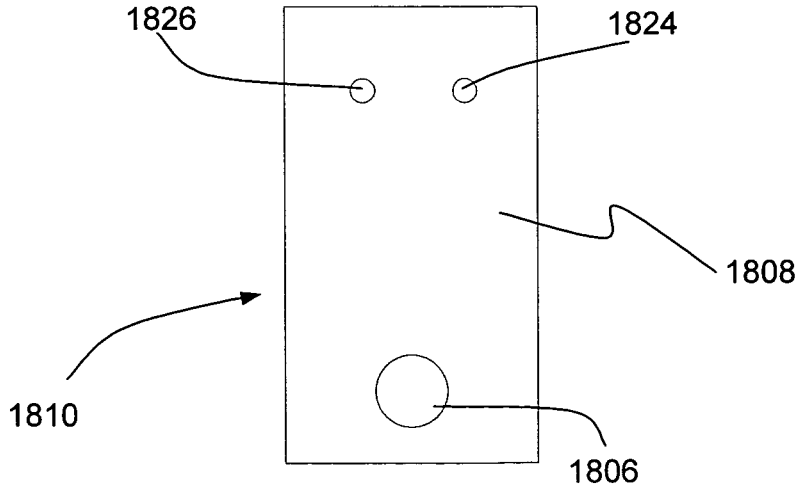
FIG. 18B is a schematic view of a die used in the method of FIG. 18A.

FIGS. 18A and 18B illustrate a die head that may be used to place a parallel cords within batten strips. In FIG. 18A, batten strip material 1802 is pumped through an extruder 1804 into an opening 1806 of a backside 1808 of a die 1810 and is drawn from die 1810 through a slot 1812 as a continuous batten strip 1814. Catch cords 1816 and 1818 from spools 1820 and 1822, respectively, are attached or embedded in continuous batten strip 1814 so that as batten strip 1814 advances, catch cords 1816 and 1818 are pulled through hollow needles 1824 and 1826, respectively, that align catch cords 1816 and 1818 in batten strip 1814 in parallel. Batten strip 1814 may be integrally bonded to a thermoplastic layer using a process such as shown in FIG. 16.

Figure 19A:
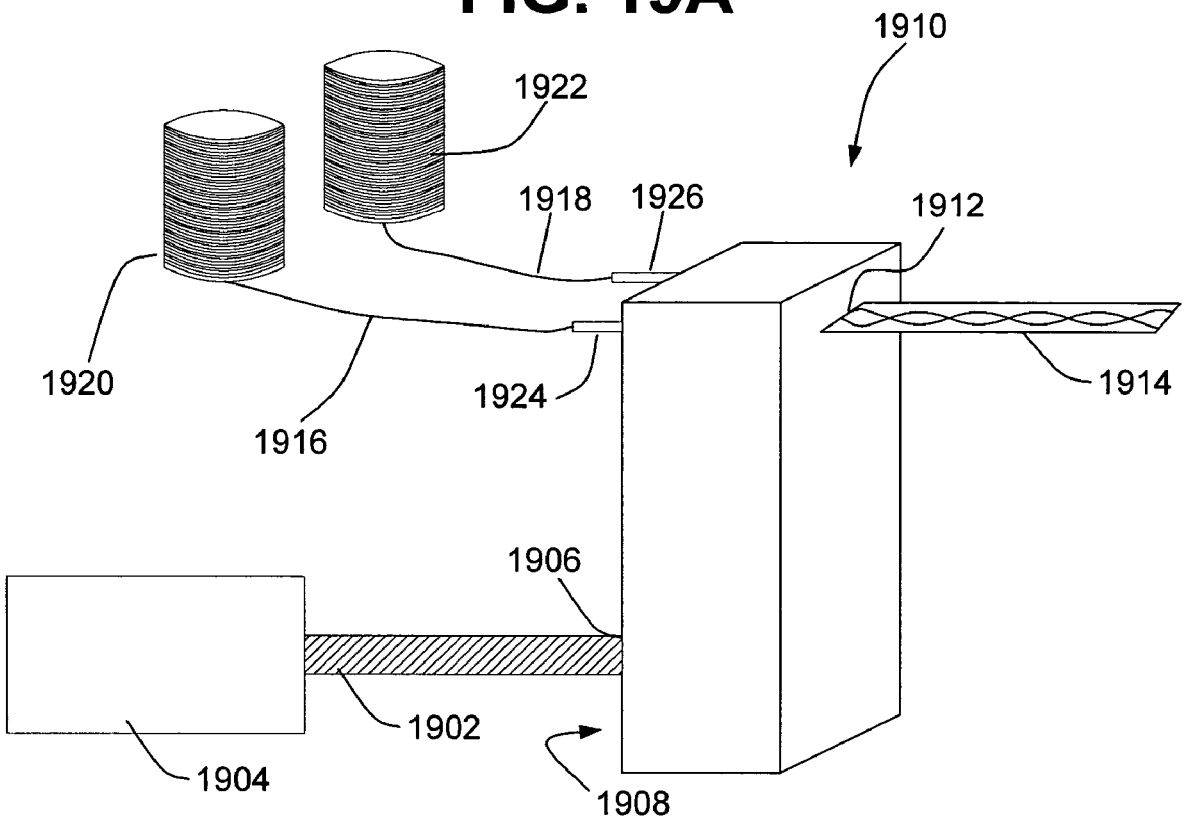
FIG. 19A is a schematic view of a method of embedding two helical cords in a batten strip.
Figure 19B:
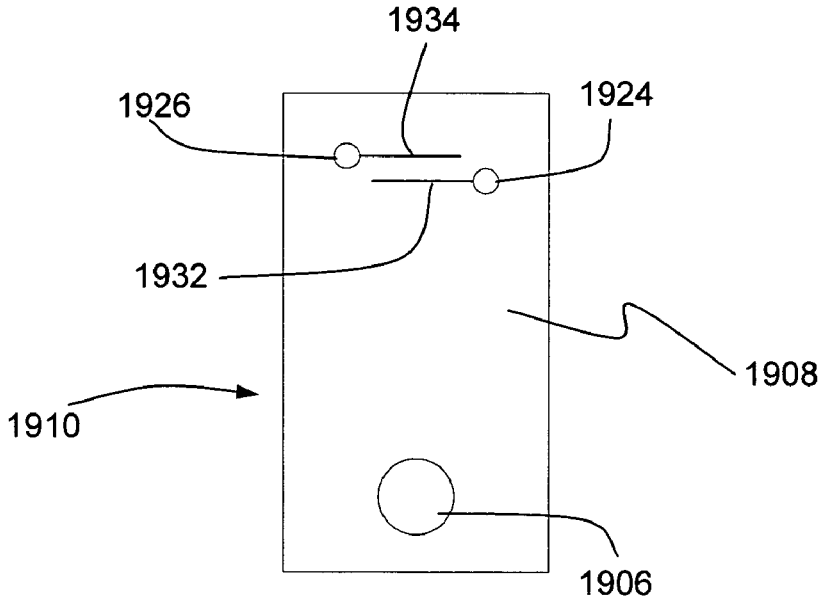
FIG. 19B is a schematic view of a die used in the method of FIG. 19A.

FIGS. 19A and 19B illustrate a die head that may be used to place a parallel cords within batten strips. In FIG. 19A, batten strip material 1902 is pumped through an extruder 1904 into an opening 1906 of a backside 1908 of a die 1910 and is drawn from die 1910 through a slot 1912 as a continuous batten strip 1914. Catch cords 1916 and 1918 from spools 1920 and 1922, respectively, are attached or embedded in continuous batten strip 1914 so that as batten strip 1914 advances, catch cords 1916 and 1918 are pulled through hollow needles 1924 and 1926, respectively, that guide catch cords 1916 and 1918. As hollow needles 1924 and 1926 are moved by a cam (not shown) from side to side and in opposite directions in guide tracks 1932 and 1934, respectively, catch cords 1916 and 1918 form a helical pattern in batten strip 1914. Batten strip 1814 may be integrally bonded to a thermoplastic layer using a process such as shown in FIG. 16.

Another method for forming a helical pattern of catch cords within a batten strip is to provide each hollow needle with a ball inset similar to a ball valve which would allow the hollow needles to be pivoted in opposite horizontal directions. Other conventional methods for controlling the motion of hollow guide needles may also be employed.

All documents, patents, journal articles and other materials cited in the present application are hereby incorporated by reference.

Although the present invention has been fully described in conjunction with the preferred embodiment thereof with reference to the accompanying drawings, it is to be understood that various changes and modifications may be apparent to those skilled in the art. Such changes and modifications are to be understood as included within the scope of the present invention as defined by the appended claims, unless they depart therefrom.

The invention claimed is:

1. A roofing product comprising:

a flexible roofing membrane comprising a first layer, said first layer being comprised of a first thermoplastic; and a batten strip integral with said roofing membrane, said batten strip comprising at least two embedded catch cords, wherein said roofing product is flexible.

2. The product of claim 1, wherein said batten strip is located on one side of said first layer of said roofing membrane.

3. The product of claim 1, wherein said batten strip is located within said first layer of said roofing membrane.

4. The product of claim 1, wherein said batten strip extends substantially along the entire length of said membrane.

5. The product of claim 1, wherein said batten strip comprises a fabric material.

6. The product of claim 1, wherein said embedded catch cords are parallel to one another.

7. The product of claim 1, wherein said embedded catch cords are in a helical configuration.

8. The product of claim 1, wherein said roofing product has a thickness of 0.03 cm to 7.62 cm.

9. The product of claim 8, wherein said roofing product has a thickness of 0.889 cm to 0.2286 cm.

10. The product of claim 1, wherein said first layer has a thickness of 0.003 cm to 2.54 cm.

11. The product of claim 10, wherein said first layer has a thickness of 0.038 cm to 0.1016 cm.

12. The product of claim 1 further comprising at least one additional batten strip.

13. The product of claim 1, wherein said batten strip has a non-uniform thickness.

14. The product of claim 1, wherein said first thermoplastic comprises a thermo-plastic polyolefin.

15. The product of claim 1, wherein said first layer includes at least one UV absorber.

16. The product of claim 1, wherein said first layer includes at least one UV screener.

17. The product of claim 1, wherein said first layer includes at least one fire retardant.

18. The product of claim 1, wherein said roofing product is capable of being rolled and unrolled.

* * * * *